US009903362B2

(12) United States Patent
Saeki et al.

(10) Patent No.: US 9,903,362 B2
(45) Date of Patent: Feb. 27, 2018

(54) CONTROL VALVE FOR A VARIABLE DISPLACEMENT COMPRESSOR

(71) Applicant: TGK CO., LTD., Tokyo (JP)

(72) Inventors: Shinji Saeki, Tokyo (JP); Masaaki Tonegawa, Tokyo (JP)

(73) Assignee: TGK CO., LTD., Tokyo (JP)

( * ) Notice: Subject to any disclaimer, the term of this patent is extended or adjusted under 35 U.S.C. 154(b) by 525 days.

(21) Appl. No.: 14/324,035

(22) Filed: Jul. 3, 2014

(65) Prior Publication Data

US 2015/0010410 A1 Jan. 8, 2015

(30) Foreign Application Priority Data

Jul. 4, 2013 (JP) ..... 2013-140645

(51) Int. Cl.
*F04B 49/22* (2006.01)
*F04B 27/18* (2006.01)
*F25B 1/00* (2006.01)

(52) U.S. Cl.
CPC ..... *F04B 49/225* (2013.01); *F04B 27/1804* (2013.01); *F25B 1/005* (2013.01);
(Continued)

(58) Field of Classification Search
CPC ..... F16K 31/0613; F04B 1/26; F04B 27/18; F04B 27/1804; F04B 49/225;
(Continued)

(56) References Cited

U.S. PATENT DOCUMENTS 5,071,321 A * 12/1991 Skinner ..... F04B 27/1804 417/222.2
5,332,365 A * 7/1994 Taguchi ..... F04B 27/1804 417/222.2

(Continued)

FOREIGN PATENT DOCUMENTS

JP S64-41680 A 2/1989
JP 2008-240580 9/2008 ..... F04B 27/14

(Continued)

OTHER PUBLICATIONS

European Search Report, App. No. EP 14 17 5543, dated Jul. 9, 2015, Munich.

(Continued)

*Primary Examiner* — Devon Kramer
*Assistant Examiner* — Joseph Herrmann
(74) *Attorney, Agent, or Firm* — Martine Penilla Group, LLP

(57) ABSTRACT

In a control valve, the spring load of a spring, which biases a main valve element in a valve opening direction, is regulated, for instance. This allows a range of suction pressures Ps, where a main valve and a sub-valve are simultaneously closed until a sub-valve element is lifted from a sub-valve seat after a main valve element has been seated on a main valve seat, to be set as a deadband. The control valve is configured such that the value of a suction pressure Ps with which to open the sub-valve after the closing of the main valve and the pressure values at which the deadband takes place are set variably by the setting of a value of current supplied to the solenoid.

2 Claims, 10 Drawing Sheets

(52) U.S. Cl.
CPC ..... *F04B 2027/1813* (2013.01); *F04B 2027/1827* (2013.01); *F04B 2027/1831* (2013.01)

(58) Field of Classification Search
CPC ..... F04B 2027/1813; F04B 2027/1827; F04B 2027/1831; F04B 2027/1854; F04B 2027/1859; F04B 2027/1877; F04B 2027/1881; F25B 1/02; F25B 1/005
USPC ..... 417/270, 222.2
See application file for complete search history.

(56) References Cited

U.S. PATENT DOCUMENTS 6,244,159 B1 * 6/2001 Kimura ..... F04B 27/1036 417/222.2
6,358,017 B1 * 3/2002 Ota ..... F04B 27/1804 417/222.2
6,361,283 B1 * 3/2002 Ota ..... F04B 27/1804 417/222.2
6,514,049 B2 * 2/2003 Mera ..... F04B 27/1804 137/601.13
2005/0053474 A1 3/2005 Hirota et al. ..... 417/222.2
2005/0254961 A1 11/2005 Kawamura et al.
2010/0068074 A1 3/2010 Shimada et al. ..... 417/222.1

FOREIGN PATENT DOCUMENTS

JP 2008240580 A 9/2008 ..... F04B 27/14
JP 2008240580 A 10/2008
WO WO 2004/065789 8/2004

OTHER PUBLICATIONS

Japanese Office Action, Notification of Reason(s) for Refusal for Patent Application No. 2013-140645, dated Nov. 1, 2016.

* cited by examiner

CONTROL VALVE FOR A VARIABLE DISPLACEMENT COMPRESSOR

CLAIM OF PRIORITY TO RELATED APPLICATION

The present application is claiming priority of Japanese Patent Application No. 2013-140645, filed on Jul. 4, 2013, the content of which is incorporated herein by reference.

BACKGROUND OF THE INVENTION

1. Field of the Invention

The present invention relates to a control valve suitable for controlling the discharging capacity of a variable displacement compressor.

2. Description of the Related Art

An automotive air conditioner generally includes a compressor, a condenser, an expander, an evaporator, and so forth. Here, the compressor discharges a high-temperature and high-pressure gaseous refrigerant produced by compressing a refrigerant flowing through a refrigeration cycle of a vehicle. The condenser condenses the gaseous refrigerant. The expander produces a low-temperature and low-pressure refrigerant by adiabatically expanding the condensed liquid refrigerant. The evaporator evaporates the refrigerant and thereby causes a heat exchange of the refrigerant with air inside a vehicle's compartment. The refrigerant evaporated by the evaporator is again brought back to the compressor and thus circulates through the refrigeration cycle.

Used as such a compressor as described above is a variable displacement compressor (hereinafter referred to simply as "compressor" also) capable of varying the refrigerant discharging capacity in order to maintain a constant level of cooling capacity irrespective of the engine speed. This compressor has a piston for compression linked to a wobble plate that is mounted to a rotational shaft rotatingly driven by an engine. And the compressor regulates the refrigerant discharge rate by changing the stroke of the piston through changes in the angle of the wobble plate. The angle of the wobble plate can be changed continuously by changing the balance of pressures working on both faces of the piston as part of the discharged refrigerant is introduced into an airtight crankcase. The pressure within this crankcase (hereinafter referred to as "crank pressure") Pc is controlled by a control valve for a variable displacement compressor (hereinafter referred to simply as "control valve" also), which is provided between the discharge chamber of the compressor and the crankcase.

One of these control valves, such as one described above, controls the crank pressure Pc by regulating the amount of refrigerant introduced into the crankcase in accordance with a suction pressure Ps, for instance. This control valve includes a pressure-sensing section, a valve section, and a solenoid. Here, the pressure-sensing section develops a displacement by sensing the suction pressure Ps; a valve section controls the opening and closing of the passage from the discharge chamber to the crankcase in response to a drive force from the pressure-sensing section; and the solenoid is capable of changing the setting value of the drive force at the pressure-sensing section by external electric current. The control valve like this opens and closes the valve section in such a manner as to maintain the suction pressure Ps at a pressure set by the external electric current. Generally, the suction pressure Ps is proportional to a refrigerant temperature at the exit of the evaporator, and thus the freezing or the like of the evaporator can be prevented by maintaining a set pressure at or above a predetermined value. Also, when the engine load of the vehicle is high, the compressor can be operated at the minimum capacity by fully opening the valve section with the solenoid turned off and by setting the wobble plate substantially at a right angle to the rotational shaft with the crank pressure Pc set high.

Also proposed in recent years as another one of the control valves is a control valve, as disclosed in Reference (1) in the following Related Art List, for instance. In this control valve, a main valve is provided in a main passage that connects the discharge chamber to the crankcase, and a sub-valve is provided in a sub-passage that connects the crankcase to the suction chamber. And both the main valve and the sub-valve are driven by a single solenoid. According to this control valve as disclosed therein, the opening degree of the main valve is regulated, during a steady operation of the air conditioner, with the sub-valve closed. Thereby, as described above, the crank pressure Pc can be controlled and the discharging capacity of the compressor can be controlled. At the same time, a so-called bleed function can be achieved by opening the sub-valve at a power-on of the air conditioner with the main valve closed and thereby quickly lowering the crank pressure Pc. Note that, in this bleed function, the compressor shifts its operation mode to a maximum-capacity operation in a relatively quick manner.

RELATED ART LIST (1) Japanese Unexamined Patent Application Publication (Kokai) No. 2008-240580.

In the control valve specifically disclosed in Reference (1), however, the main valve element, which constitutes the main valve, and the sub-valve element, which constitutes the sub-valve, are arranged in series with each other so as to form a series unit. And this control valve is configured such that the solenoid is arranged on one end side of the series unit and such that the pressure-sensing section is arranged on the other end side thereof. The pressure-sensing section practically senses the suction pressure Ps and thereby generates a drive force opposing the solenoidal force. When the main valve is being controlled, the main valve element and the sub-valve become integrated with each other and then the opening degree of the main valve is regulated in accordance with the balance between the solenoidal force and the drive force of the pressure-sensing section. The sub-valve is opened when the sub-valve element is separated or spaced apart from the main valve element after the main valve has been closed. However, the opening/closing operations of the main valve and the sub-valve are dependent on how high the suction pressure Ps is. For this reason, the main valve and the sub-valve are sometimes alternately opened and closed when the suction pressure Ps varies near a fully-closed point where both the main valve and the sub-valve are simultaneously closed. This produces a rasping hitting sound in the valve section. Also, the controllability of a bleed function and the like may possibly be lost then and therefore the control valve still had room for improvement in this regard.

SUMMARY OF THE INVENTION

The present invention has been made in view of the foregoing problems, and a purpose thereof is to provide a control valve for a variable displacement compressor capable of achieving the bleed function in a more stabilized manner and more effectively.

In order to resolve the aforementioned problems, a control valve for a variable displacement compressor according to one embodiment of the present invention varies a discharging capacity of the compressor for compressing refrigerant led into a suction chamber and discharging the compressed refrigerant from a discharge chamber, by regulating a flow rate of the refrigerant led into a crankcase from the discharge chamber, and the control valve includes: a body having a discharge chamber communication port that communicates with the discharge chamber, a crankcase communication port that communicates with the crankcase, a suction chamber communication port that communicates with the suction chamber, a main passage that communicates between the discharge chamber communication port and the crankcase communication port, and a sub-passage that communicates between the crankcase communication port and the suction chamber communication port; a main valve seat provided in the main passage; a main valve element configured to open and close a main valve by touching and leaving the main valve seat; a power element configured to supply a drive force in a valve opening direction to the main valve element according to a displacement amount of a pressure-sensing member, the power element including the pressure-sensing member for sensing a predetermined pressure-to-be-sensed and developing a displacement in an opening or closing direction of the main valve; a solenoid configured to generate a force opposing the drive force of the power element when the solenoid electrically conducts; an actuating rod configured to transmit a force generated by the solenoid to the power element, the actuating rod being coupled with the solenoid; a sub-valve seat provided in the sub-passage; a sub-valve element configured to open and close a sub-valve by touching and leaving the sub-valve seat; and a biasing member configured to bias the main valve element in a closing direction of the main valve.

Also, the control valve is configured such that a range of the pressures-to-be-sensed, where the main valve and the sub-valve are simultaneously closed until the sub-valve element is lifted from the sub-valve seat after the main valve element has been seated on the main valve seat, is set as a deadband, by regulating the load of the biasing members, and such that a value of the pressure-to-be-sensed with which to close the main valve, a value of the pressure-to-be-sensed with which to open the sub-valve after the main valve has been closed, and pressure values at which the deadband takes place are set variably by setting a value of current supplied to the solenoid.

By employing this embodiment, regulating the load of the biasing members allows the setting of a deadband, where the main valve and the sub-valve are simultaneously closed, even in the event that the pressure-to-be-sensed is varied. In other words, the pressure-to-be-sensed (till the opening of the sub-valve after the closing of the main valve) can be given a certain range of values and therefore the setting can be done such that the sub-valve is opened under a pressure value, at which the main valve is not easily opened, by varying the pressure-to-be-sensed. Similarly, the setting can be done such that the main valve is opened under a pressure value, at which the sub-valve is not easily opened, by varying the pressure-to-be-sensed. This can prevent a situation like one where the main valve and the sub-valve are alternately opened and closed, so that the bleed function can be achieved in a more stabilized manner. This also causes both a pressure-to-be-sensed, which determines a valve closing point of the main valve, and a pressure-to-be-sensed, which determines the valve opening point of the sub-valve, to vary according to a value of current supplied to the solenoid (supply current value). More specifically, the values at which the main valve and the sub-valve are to be opened are varied, as appropriate, by varying the value of current supplied to the solenoid. Thus, the condition under which the sub-valve can be opened is not limited to the cases where the pressure sensed by the power element exceeds a specific pressure value (fixed value). Hence, the bleed function can be appropriately achieved depending on an air-conditioning state or environment.

BRIEF DESCRIPTION OF THE DRAWINGS

Embodiments will now be described by way of examples only, with reference to the accompanying drawings which are meant to be exemplary, not limiting, and wherein like elements are numbered alike in several Figures in which.

DETAILED DESCRIPTION OF THE INVENTION

The present invention will now be described in detail based on preferred embodiments with reference to the accompanying drawings. This does not intend to limit the scope of the present invention, but to exemplify the invention.

In the following description, for convenience of description, the positional relationship in each structure may be expressed as "vertical" or "up-down" with reference to how each structure is depicted in Figures.

Figure 1:
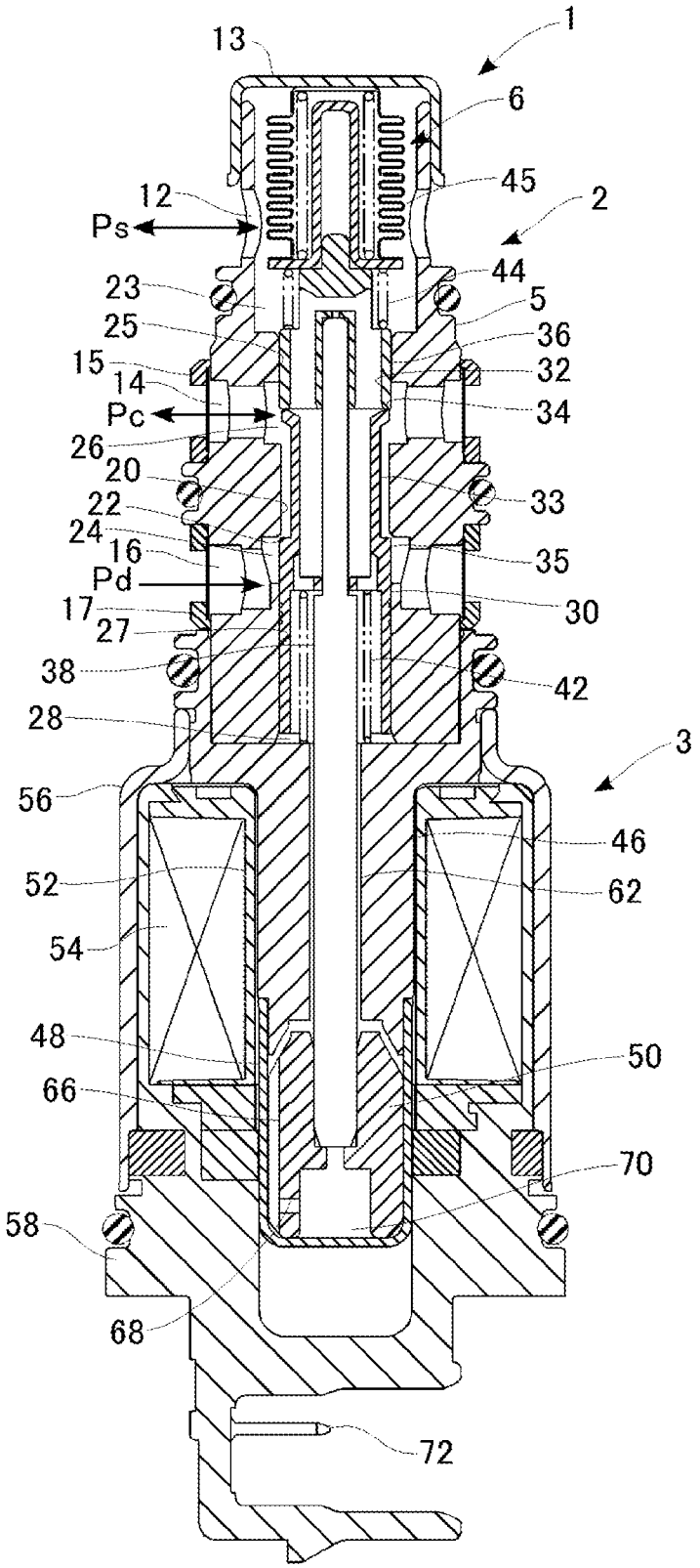
FIG. 1 is a cross-sectional view showing a structure of a control valve according to an embodiment.

FIG. 1 is a cross-sectional view showing a structure of a control valve according to an embodiment.

A control valve 1 is configured as an electromagnetic valve for controlling the discharging capacity of a not-shown variable displacement compressor (hereinafter referred to simply as "compressor") installed for a refrigeration cycle of an automotive air conditioner. This compressor discharges a high-temperature and high-pressure gaseous refrigerant produced by compressing a refrigerant flowing through the refrigeration cycle. The gaseous refrigerant is then condensed by a condenser (external heat exchanger) and further adiabatically expanded by an expander so as to become a misty, low-temperature and low-pressure refrigerant. This low-temperature and low-pressure refrigerant is evaporated by an evaporator, and the evaporative latent heat cools the air of an interior of a vehicle. The refrigerant evaporated by the evaporator is again brought back to the compressor and thus circulates through the refrigeration cycle. The compressor, which has a rotational shaft rotatingly driven by an engine of an automobile, is configured such that a piston for compression is linked to a wobble plate mounted to the rotational shaft. The compressor regulates a refrigerant discharge rate by changing the stroke of the piston through changes in the angle of the wobble plate. The control valve 1 changes the angle of the wobble plate and consequently changes the discharging capacity of the compressor by controlling a flow rate of the refrigerant to be introduced from a discharge chamber to a crankcase of the compressor.

The control valve 1 is constituted as a so-called Ps sensing valve that controls the flow rate of refrigerant introduced from the discharge chamber to the crankcase so that a suction pressure Ps of the compressor can be maintained at a certain set pressure. Note here that the suction pressure Ps thereof corresponds to "pressure-to-be-sensed". The control valve 1 is constructed by integrally assembling a valve unit 2 and a solenoid 3. The valve unit 2 includes a main valve for opening and closing a refrigerant passage used to lead a part of the discharged refrigerant to the crankcase, during an operation of the compressor, and a sub-valve that functions as a so-called bleed valve for releasing the refrigerant in the crankcase to a suction chamber, at a startup of the compressor. The solenoid 3 regulates the opening degree of the main valve by driving the main valve in a valve opening or closing direction, and controls the flow rate of refrigerant introduced into the crankcase. The valve unit 2 includes a body 5 of stepped cylindrical shape, a main valve and a sub-valve, which are provided inside the body 5, a power element 6, which generates a drive force against a solenoidal force to adjust the opening level of the main valve, and so forth. The power element 6 functions as a "pressure-sensing section".

The body 5 has ports 12, 14 and 16 in this order from top down. The port 12 functions as a "suction chamber communication port" and communicates with the suction chamber of the compressor. The port 14 function as a "crankcase communication port" and communicates with the crankcase of the compressor. The port 16 functions as a "discharge chamber communication port" and communicates with the discharge chamber of the compressor. An end member 13 is fixed to an upper-end opening of the body 5 in such a manner as to close the upper-end opening thereof. A lower end of the body 5 is coupled to an upper end of the solenoid 3.

A main passage, which communicates the port 16 with the port 14, and a sub-passage, which communicates the port 14 with the port 12 are formed inside the body 5. The main valve is provided in the main passage, whereas the sub-valve is provided in the sub-passage. In other words, the control valve 1 is configured such that the power element 6, the sub-valve, the main valve, and the solenoid 3 are arranged in this order starting from one end side of the body 5. A main valve hole 20 and a main valve seat 22 are provided in the main passage. A sub-valve hole 32 and a sub-valve seat 34 are provided in the sub-passage.

A working chamber 23, which is partitioned in an upper portion of the body 5, and the suction chamber are communicated with each other through the port 12. The power element 6 is disposed in the working chamber 23. Through the port 16, the refrigerant at a discharge pressure Pd is introduced from the discharge chamber. A main valve chamber 24 is provided between the port 16 and the main valve hole 20, and the main valve is arranged in the main valve chamber 24. Through the port 14, the refrigerant at the crank pressure Pc having passed through the main valve is led out toward the crankcase during a steady operation of the compressor. Also, through the port 14, the refrigerant at the crank pressure Pc discharged from the crankcase is led in at a startup of the compressor. A sub-valve chamber 26 is provided between the port 14 and the main valve hole 20, and the sub-valve is arranged in the sub-valve chamber 26. Through the port 12, the refrigerant at the suction pressure Ps is led in during the steady operation of the compressor. Also, through the port 12, the refrigerant at the suction pressure Ps having passed through the sub-valve is led out toward the suction chamber at the startup of the compressor. Ring-shaped strainers 15 and 17 are provided around the ports 14 and 16, respectively. The strainers 15 and 17 each includes a filter that suppresses foreign materials from entering into the interior of the body 5.

The main valve hole 20 is formed between the main valve chamber 24 and the sub-valve chamber 26, and the main valve seat 22 is formed on a lower-end opening end of the main valve hole 20. A guiding passage 25 (functioning as a "second guiding passage") is provided between the port 14 and the working chamber 23. A guiding passage 27 (functioning as a "first guiding passage") is provided in a lower portion of the body 5 (on an opposite side of the main valve hole 20 of the main valve chamber 24). A main valve element 30 of cylindrical shape is slidably inserted to the guiding passage 27.

The diameter of an upper half of the main valve element 30 is slightly reduced, and the upper half of the main valve element 30 runs through the main valve hole 20 and forms a partition 33 that separates the inside and the outside of the main valve element 30. A stepped portion formed in a middle part of the main valve element 30 touches and leaves the main valve seat 22 so as to become a valve formation part 35. The main valve element 30 closes and opens the main valve by touching and leaving the main valve seat 22 from a main valve chamber 24 side, respectively. Thereby the main valve element 30 regulates the flow rate of refrigerant flowing from the discharge chamber to the crankcase. An upper end surface of the partition 33 constitutes the sub-valve seat 34. The sub-valve seat 34 functions as a movable seat that moves (develops a displacement) together with the main valve element 30.

A sub-valve element 36 of stepped cylindrical shape is slidably inserted to the guiding passage 25. An internal passage of the sub-valve element 36 is the sub-valve hole 32. This internal passage communicates the sub-valve chamber 26 with the working chamber 23 by opening the sub-valve. The sub-valve element 36 and the sub-valve seat 34 are disposed counter to each other in the direction of axis line. The sub-valve element 36 closes and opens the sub-valve by touching and leaving the sub-valve seat 34, respectively.

An elongated actuating rod 38 is provided along an axis line of the body 5. The actuating rod 38 and the power element 6 are connected such that an upper end of the actuating rod 38 can be operatively coupled or linked to the power element 6 by way of the sub-valve element 36. The actuating rod 38 and a plunger 50 (described later) of the solenoid 3 are connected such that a lower end of the actuating rod 38 can be operatively coupled or linked to the plunger 50. An upper half of the actuating rod 38 penetrates the main valve element 30, and the actuating rod 38 supports the sub-valve element 36 from below at the upper end thereof.

A spring 42 (functioning as a "biasing member") that biases the main valve element 30 in a closing direction of the main valve is set between the main valve element 30 and the solenoid 3. Also, a spring 44 (functioning as a "biasing member") that biases not only the sub-valve element 36 in a closing direction of the sub-valve but also the main valve element 30 in an opening direction of the main valve is set between the power element 6 and the sub-valve element 36. In the present embodiment, the spring load of the spring 44 is set such that the spring load thereof is larger than that of the spring 42.

The power element 6 includes a bellows 45 that develops a displacement by sensing the suction pressure Ps and generates an opposing force to oppose the solenoidal force by the displacement of the bellows 45. This opposing force is also transmitted to the main valve element 30 by way of the sub-valve element 36. When the sub-valve element 36 is seated on the sub-valve seat 34 with the result that the sub-valve is closed, the relief of refrigerant from the crankcase to the suction chamber is blocked. Also, when the sub-valve is opened with the sub-valve element 36 spaced apart from the sub-valve seat 34, the relief of refrigerant from the crankcase to the suction chamber is permitted.

The solenoid 3 includes a stepped cylindrical core 46, a bottomed cylindrical sleeve 48, which is so assembled as to seal off a lower-end opening of the core 46, a stepped cylindrical plunger 50, which is housed in the sleeve 48 and which is disposed in a position opposite to the core 46 in the direction of axis line, a cylindrical bobbin 52, which is inserted around the core 46 and sleeve 48, an electromagnetic coil 54, wound around the bobbin 52, which generates a magnetic circuit when the solenoid 3 electrically conducts, a casing 56, which is so provided as to cover the electromagnetic coil 54 from outside and which also functions as a yoke, and an end member 58, which is so provided as to seal off a lower-end opening of the casing 56. In the present embodiment, the body 5, the core 46, the casing 56 and the end member 58 form a body for the whole control valve 1.

The valve unit 2 and the solenoid 3 are secured such that a lower end of the body 5 is press-fitted to an upper-end opening of the core 46. A pressure chamber 28 is formed between the core 46 and the main valve 30. The actuating rod 38 is inserted to the core 46 such that the actuating rod 38 penetrates a center of the core 46 in the direction of axis line. The suction pressure Ps of the pressure chamber 28 passes through a communicating path 62, which is formed by the spacing between the actuating rod 38 and the core 46, and is then led into the sleeve 48 as well.

The spring 44 functions as an off-spring that biases both the core 46 and the plunger 50 in a direction in which they get mutually separated apart from each other. The actuating rod 38 is coaxially connected to the sub-valve element 36 and the plunger 50, respectively, but is not fixed thereto. In other words, the upper end of the actuating rod 38 is loosely fit to the sub-valve element 36, and the lower end thereof is loosely fit to the plunger 50. This is because the spring 44 (off-spring) is provided between the sub-valve element 36 and the power element 6 and therefore no problem is caused even though the actuating rod 38 is not fixed by press-fitting or the like to the sub-valve element 36 and the plunger 50. On the contrary, eliminating such fixation by press-fitting can improve the workability of each of components, which are the sub-valve element 36, the actuating rod 38 and the plunger 50, and also can improve the assembling capability of these components. In a modification, the actuating rod 38 may be fixed by press-fitting to at least one of the sub-valve element 36 and the plunger 50.

The actuating rod 38 is supported by the plunger 50 from below and is configured such that actuating rod 38 can be operatively coupled or linked to the main valve element 30, the sub-valve element 36 and the power element 6. The actuating rod 38 appropriately transmits the solenoidal force, which is a suction force generated between the core 46 and the plunger 50, to the main valve element 30 and the sub-valve element 36. At the same time, a drive force, which is generated by an expansion/contraction movement of the power element 6, is so exerted on the actuating rod 38 as to oppose the solenoidal force. Hereinafter, this drive force to oppose the solenoidal force will be referred to as "pressure-sensing drive force" also. In other words, when the main valve is under control, the force adjusted by the solenoidal force and the pressure-sensing drive force acts on the main valve element 30 and appropriately controls the opening degree of the main valve. At a startup of the compressor, the actuating rod 38 resisting the biasing force of the spring 44 is displaced relative to the body 5 in accordance with the magnitude of the solinoidal force, pushes up the sub-valve element 36 after having closed the main valve, and thereby opens the sub-valve. As the suction pressure Ps increases substantially even while the main valve being under controlled, the actuating rod 38 resisting the biasing force of the bellows 45 is displaced relative to the body 5, pushes up the sub-valve element 36 after having closed the main valve, and thereby opens the sub-valve. As a result, a bleed function is achieved.

The sleeve 48 is made of a nonmagnetic material. A plurality of communicating grooves 66 are provided, in parallel with the axis line, on a side of the plunger 50. A communicating hole 68, which communicates the inside and outside of the plunger 50, is provided in a lower portion of the plunger 50. Such a structure as this enables the suction pressure Ps to be led to a back pressure chamber 70 through the spacing between the plunger 50 and the sleeve 48 even though the plunger 50 is positioned at a bottom dead point as shown in FIG. 1.

A pair of connection terminals 72 connected to the electromagnetic coil 54 extend from the bobbin 52 and are led outside by penetrating the end member 58. Note that only one of the pair of connection terminals 72 is shown in FIG. 1 for convenience of explanation. The end member 58 is installed in such a manner as to seal the entire structure inside the solenoid 3 contained in the casing 56 from below. The end member 58 is molded (injection molding) of a corrosion-resistant resin, and the resin material is filled into gaps between the casing 56 and the electromagnetic coil 54 also. With the resin material filled into the gaps between the casing 56 and the electromagnetic coil 54, the heat release performance is enhanced because the heat generated by the electromagnetic coil 54 is easily conveyed to the casing 56. The ends of the connection terminals 72 are led out from the end member 58 and connected to a not-shown external power supply.

Figure 2A:
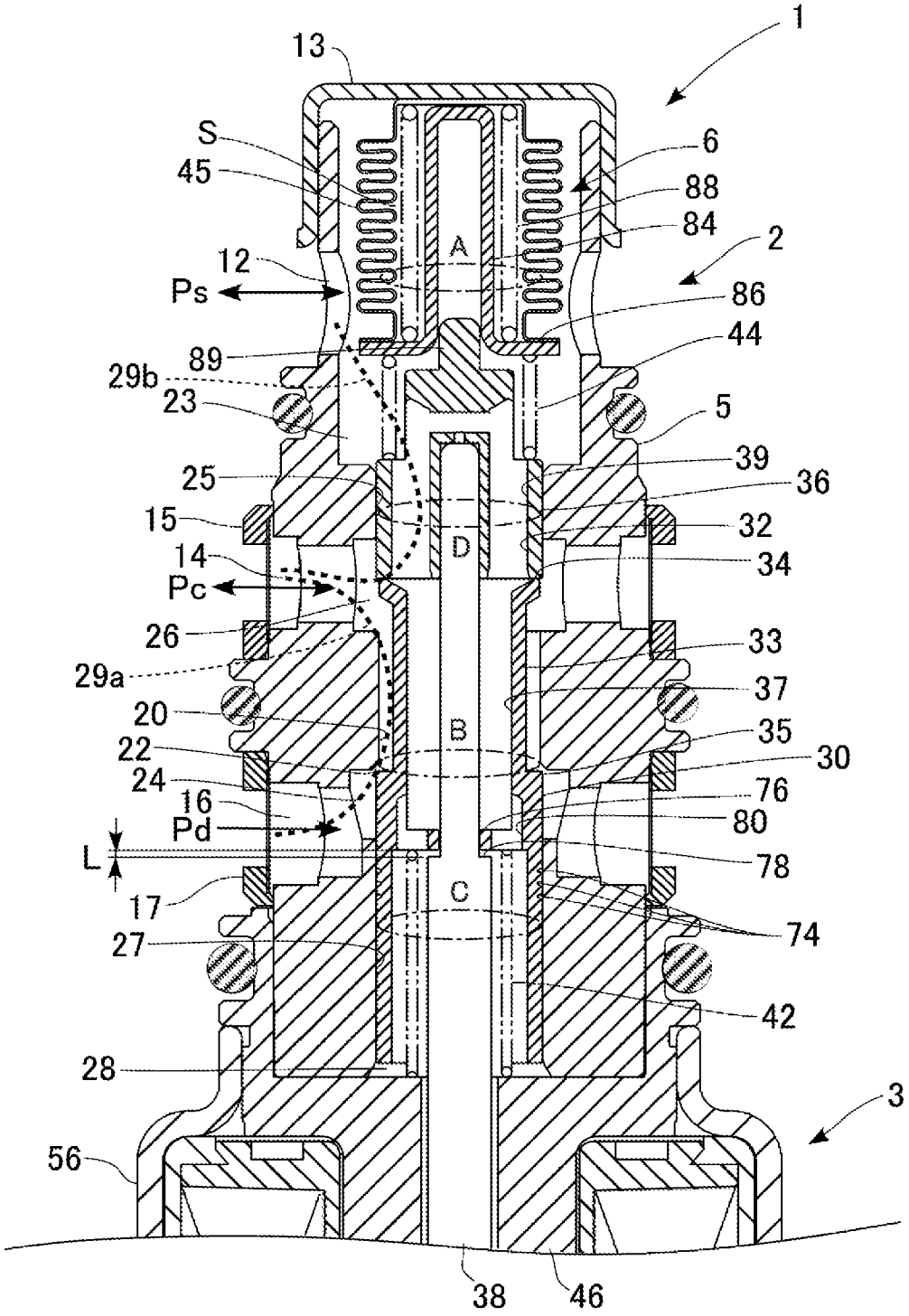
FIG. 2A is a partially enlarged cross-sectional view of the upper half of FIG. 1.

FIG. 2A is a partially enlarged cross-sectional view of the upper half of FIG. 1.

A labyrinth seal 74 having a plurality of annular grooves by which to restrict the passage of refrigerant is provided in a sliding surface of the main valve element 30 relative to the guiding passage 27. A dividing wall 76 is provided in a middle part of the main valve element 30 along the direction of axis line. An underside of the dividing wall 76 functions as a "to-be-engaged portion" capable of being engaged with the actuating rod 38 as appropriate. The diameter of an upper portion of the actuating rod 38 is reduced and this reduced diameter portion of the actuating rod 38 runs through an insertion hole formed in a center of the dividing wall 76. A stepped portion of the reduced diameter portion of the actuating rod 38 constitutes an engagement portion 78 in the actuating rod 38. A plurality of through-holes 80, through which the refrigerants pass, are formed around the insertion hole of the dividing wall 76.

The spring 42 is set between the dividing wall 76 and the core 46. In the structure like this, the contact point of the spring 42 and the main valve element 30 is situated more toward a main valve chamber 24 side than a middle of a sliding portion in the guiding passage 27. Thus, the main valve element 30 is stably supported by the spring 42 as with a so-called balancing toy. As a result, the occurrence of hysteresis caused by a fluctuating or wobbling movement made when the main valve element 30 is driven to open and close can be prevented or suppressed.

A plurality of internal passages 39, by which to communicate an internal passage 37 of the main valve element 30 with the working chamber 23, are formed in the sub-valve element 36. Openings of the internal passages 39 are formed both at a plurality of positions of a side surface of an upper part of the sub-valve element 36 and on an underside of the sub-valve element 36. The position of the stepped portion of the actuating rod 38 is set such that the engagement portion 78 is spaced apart from the dividing wall 76 at a predetermined interval L or more, while the sub-valve element 36 is seated on the sub-valve seat 34. The predetermined L serves as a so-called "play" or "backlash".

As the solenoidal force is increased, the actuating rod 38 is displaced relative to the main valve element 30 and thereby the sub-valve element 36 can be lifted. As a result, the sub-valve element 36 and the sub-valve seat 34 can be spaced apart from each other so as to open the sub-valve. Also, the solenoidal force can be directly conveyed to the main valve element 30 with the engagement portion 78 and the dividing wall 76 being engaged with (abutted against) each other, so that the main valve element 30 can be pressed in a closing direction of the main valve with great force. This structure functions as a lock release mechanism that releases a locked state where the main valve element 30 is locked as a result of the entanglement of foreign material in the sliding portion of the main valve element 30 relative to the guiding passage 27.

The main valve chamber 24 is formed coaxially with the body 5 and is constructed as a pressure chamber whose diameter is larger than that of the main valve hole 20. Thus, a relatively large space is formed between the main valve and the port 16, so that a sufficiently large flow rate of refrigerant flowing through the main passage 29*a* can be ensured when the main valve is opened. Similarly, the sub-valve chamber 26 is formed coaxially with the body 5, too, and is constructed as a pressure chamber whose diameter is larger than that of the main valve hole 20. Thus, a relatively large space is formed between the sub-valve and the port 14. As shown in FIG. 2, an attaching/detaching portion located in between an upper end of the main valve element 30 and a lower end of the sub-valve element 36 is so set at a central part of the sub-valve chamber 26. In other words, a movable range of the main valve element 30 is set such that the sub-valve seat 34 is constantly located within the sub-valve chamber 26, and therefore the sub-valve is opened or closed in the sub-valve chamber 26. This can ensure a sufficient flow rate of refrigerant flowing through the sub-valve passage 29*b* when the sub-valve is opened. That is, the bleed function can be effectively achieved.

The power element 6 is configured by including a base member 84 and a bellows 45 (functioning as a "pressure-sensing member"). The base member 84, which is constructed in a bottomed cylindrical shape by press-forming a metal, has a flange 86 that extends radially outward at a lower end opening thereof. The bellows 45 is configured such that an upper end of the bellows-like body thereof is closed and such that a lower end opening part thereof is hermetically welded to an upper surface of the flange 86. The interior of the bellows 45 is an airtight reference pressure chamber S, and a spring 88 that biases the bellows 45 in an expanding direction is set between the bellows 45 and the flange 86. The reference pressure chamber S is in a vacuum state. The bellows 45 expands and contracts with a body of the base member 84 as an axial center. The bellows 45 abuts against and is supported by the end member 13 at an end thereof opposite to the flange 86.

In other words, the end member 13 is a fixed end of the power element 6. The set load of the power element 6 (i.e., the set load of the spring 88) can be adjusted by adjusting a press-fitting amount of the end member 13 to body 5. In a radially inward space of the bellows 45, a body of the base member 84 extends to a location near a bottom portion of the bellows 45, and an upper end (a bottom of the base member 84) of the body of the base member 84 is located near the bottom portion of the bellows 45. The sub-valve element 36 is configured such that a fitting section 89 protruding upward is provided in a center of an upper end surface thereof and then the fitting section 89 is fitted to the body of the base member 84. The bellows 45 expands or contracts in the direction of axis line (opening/closing direction of the main valve and the sub-valve) according to a pressure difference between the suction pressure Ps of the working chamber 23 and the reference pressure of the reference pressure chamber S. A valve-opening-direction driving force is applied to the main valve element 30 according to the displacement of the bellows 45. However, if the pressure difference becomes large, the bottom portion of the bellows 45 comes in contact with the body of the base member 84 and will be stopped thereby as a result of a predetermined contraction of the bellows 45, thus restricting the contraction.

According to the present embodiment, an effective pressure-receiving diameter A of the bellows 45, an effective pressure-receiving diameter B (seal section diameter) of the main valve element 30 in the main valve, a sliding portion diameter C (seal section diameter) of the main valve element 30, and a sliding portion diameter D (seal section diameter) of the sub-valve element 36 are set equal to each other. Thus, the effect of the discharge pressure Pd, the crank pressure Pc and the suction pressure Ps acting on a combined unit of the main valve element 30 and the sub-valve element 36 is cancelled. As a result, when the main valve is under control, the main valve element 30 is opened or closed according to the suction pressure Ps received by the power element 6 at the working chamber 23. That is, the control valve 1 functions as the so-called Ps sensing valve.

In a modification, the diameters B, C and D are set equal to each other, and the effective pressure-receiving diameter A may be set to a value different from the diameters B, C and D. That is, as described above in the present embodiment, the diameters B, C and D are set equal to each other, and the internal passages of the valve elements (the main valve element 30 and the sub-valve element 36) are made to penetrate vertically. Thereby, the effect of the pressures (Pd, Pc and Ps) acting on the valve elements can be cancelled. Specifically, the pressures on the both ends (in the vertical direction in FIG. 2) of a combined unit of the main valve element 30, the sub-valve element 36, the actuating rod 38 and the plunger 50 are set to the same pressure (the suction pressure Ps), thereby canceling the pressures. As a result, the diameter of each valve element can be set independently of the diameter of the bellows 45. Suppose, for example, that the size of the bellows 45 is made smaller. Then, the valve elements can still be configured while the diameter of each valve element remains large. In other words, the size of the main valve can be made larger, and the size of the sub-valve can be made larger. As a result, the flow rate of the bleed valve can be set larger. Conversely, the effective pressure-receiving diameter A may be set to a value larger than the diameters B, C and D. This can increase the design freedom of the bellows 45, the main valve element 30 and the sub-valve element 36.

Figure 2B:
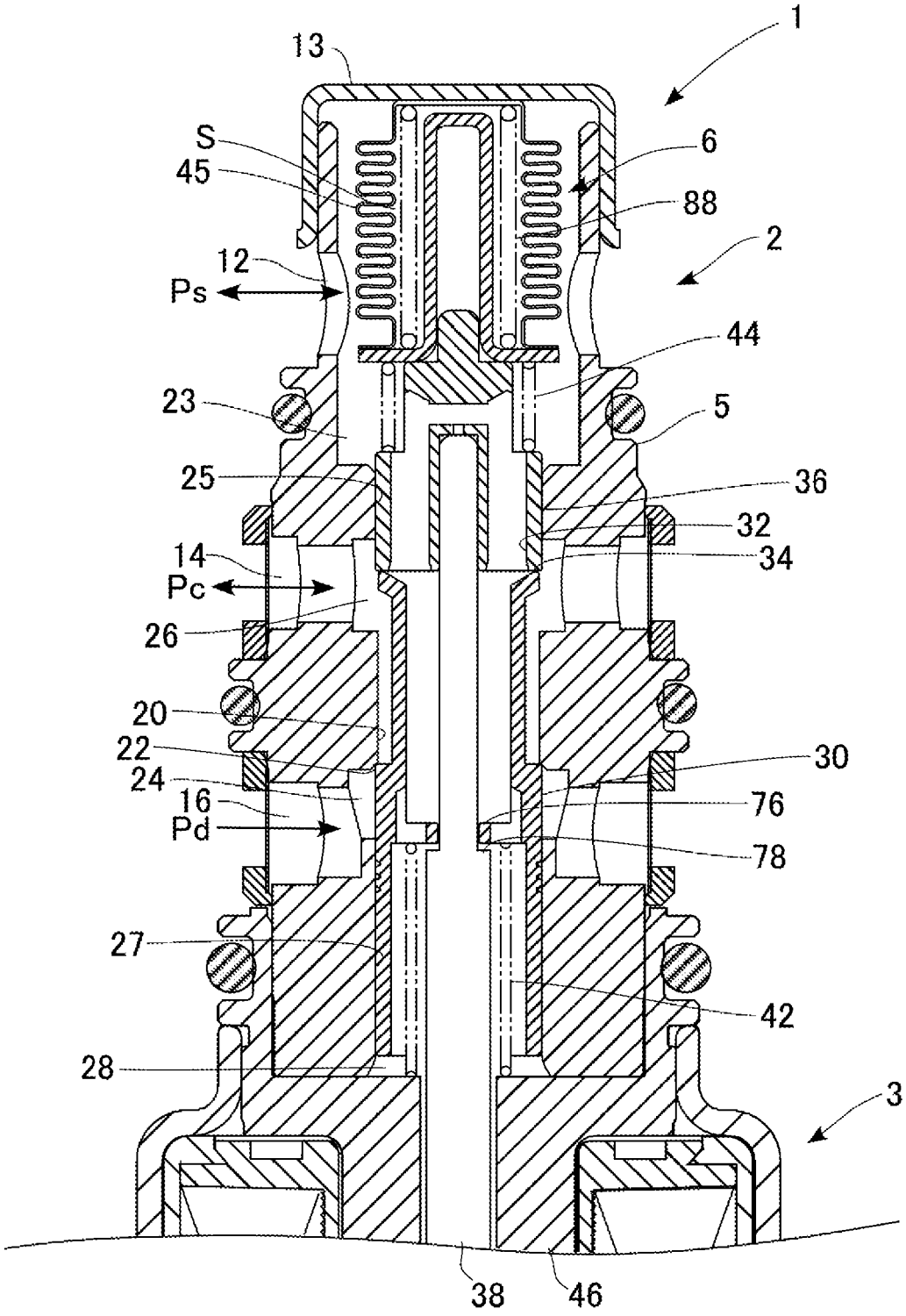
FIG. 2B shows an operation of a control valve.
Figure 3:
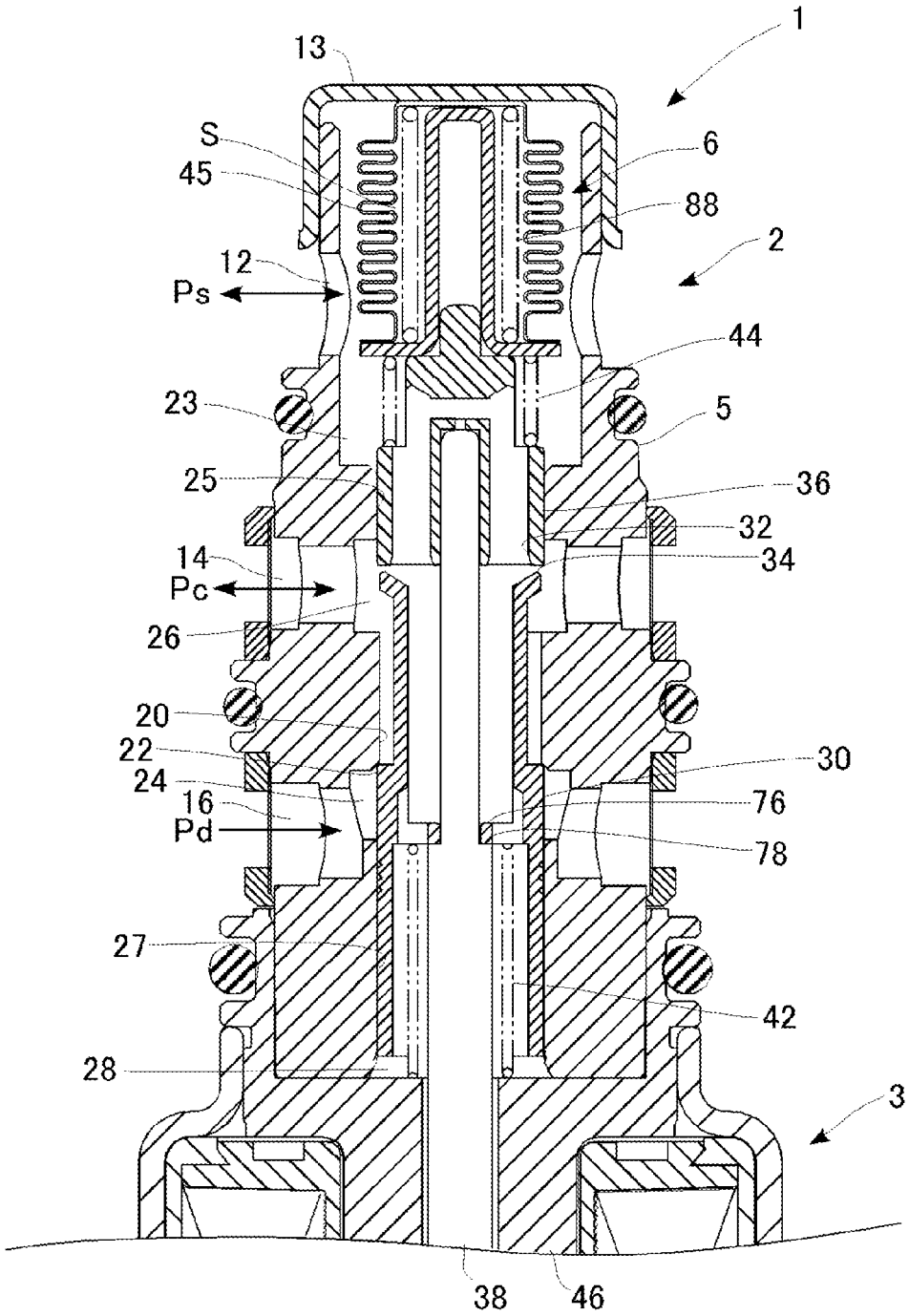
FIG. 3 shows an operation of a control valve.
Figure 4:
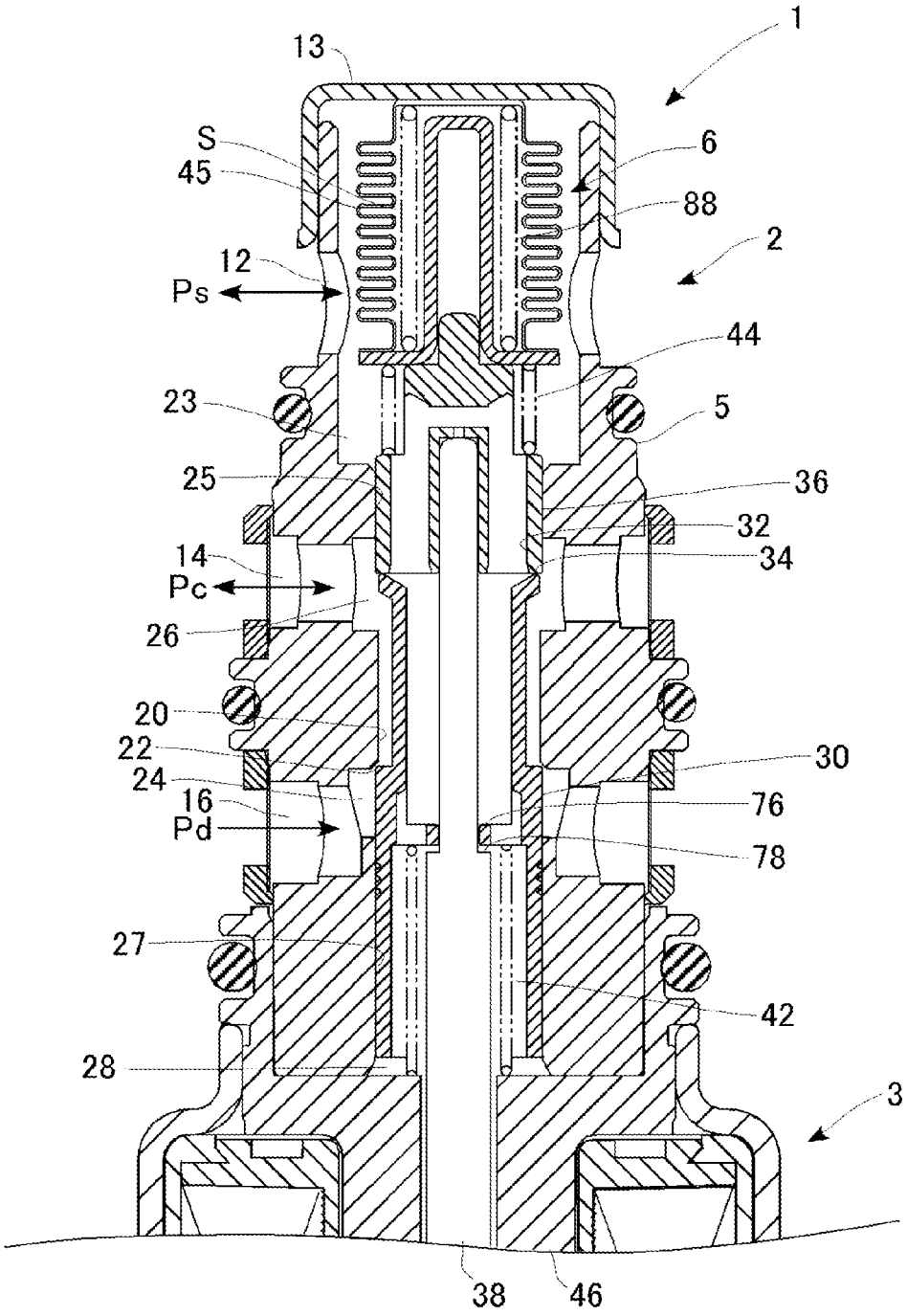
FIG. 4 shows an operation of a control valve.

Now, an operation of the control valve will be explained. FIG. 2A to FIG. 4 are each a diagram to explain an operation of the control valve, and FIG. 2A to FIG. 4 correspond to FIG. 2A. FIG. 2A, already described above, shows a state where the control valve operates with the minimum capacity. FIG. 3 shows a state where a bleed function is in effect. FIG. 4 shows a relatively stable controlled state. A description is given hereinbelow based on FIG. 1 with reference to FIG. 2A to FIG. 4, as appropriate.

While the solenoid 3 of the control valve 1 is not electrically conducting, namely while the automotive air conditioner is not operating, no suction power between the core 46 and the plunger 50 is in effect. At the same time, the suction pressure Ps is relatively high under normal circumstances. Thus, as shown in FIG. 2A, the bellows 45 contracts and, in this state, the biasing force of the spring 44 is transmitted to the main valve element 30 by way of the sub-valve element 36. As a result, the main valve element 30 is spaced apart from the main valve seat 22, and the main valve is fully opened. At this time, the power element 6 is substantially disabled, and no force in the valve opening direction acts on the sub-valve element 36. Accordingly, the sub-valve remains closed.

On the other hand, as a starting current is supplied to the electromagnetic coil 54 of the solenoid 3 at the startup of the automotive air conditioner, the sub-valve is opened if the suction pressure Ps is higher than a valve opening pressure determined by the supply current value (hereinafter referred to as "sub-valve opening pressure" also). In other words, the solenoidal force overcomes the biasing force of the spring 44 and thereby the sub-valve element 36 is pushed up. As a result, the sub-valve element 36 is spaced apart from the sub-valve seat 34, and the bleed function is effectively achieved. During this operational process, the main valve element 30 is pushed up by the biasing force of the spring 42 and is then seated on the main valve seat 22. As a result, the main valve is closed. That is, after the main valve is closed and thereby the delivery of discharged refrigerant into the crankcase is restricted, the sub-valve is opened and the refrigerant in the crankcase is promptly relived into the suction chamber. This can promptly start the compressor.

Even when the suction pressure Ps is low and the bellows 45 has expanded, such as when a vehicle is exposed to a low-temperature environment, the sub-valve is opened if the suction pressure Ps is higher than the sub-valve opening pressure determined by the supply current value. In other words, as shown in FIG. 3, the solenoidal force overcomes the biasing force of the bellows 45 and thereby the power element 6 and the sub-valve element 36 are pushed up in an integrated manner. As a result, the sub-valve element 36 is spaced apart from the sub-valve seat 34, and the bleed function is effectively achieved. Note that if a set pressure Pset (described later) is varied according to an environment to which the vehicle is exposed, the "sub-valve opening pressure" varies accordingly as well.

As long as the value of current supplied to the solenoid 3 (supply current value) is within a range of control values for the main valve, the opening degree of the main valve is autonomously regulated such that the suction pressure Ps is equal to the set pressure Pset set by the supply current value. Since the spring load of the spring 44 is sufficiently large, the sub-valve element 36 is seated on the sub-valve seat 34 and the sub-valve maintains its closed state as shown in FIG. 4, while the main valve is under control. On the other hand, the suction pressure Ps is relatively low. As a result, the bellows 45 expands and the main valve element 30 is moved to regulate the opening degree of the main value. At this time, the main valve element 30 stops at a valve-lift position where forces are all balanced. Here, the force by the spring 42 in the valve closing direction, the solenoidal force in the valve closing direction, and the force by the power element 6 in response to the suction pressure Ps in the valve opening direction.

As, for example, the refrigeration load becomes large and the suction pressure Ps becomes higher than the set pressure Pset, the bellows 45 contracts with the result that the main valve element 30 is displaced relatively upward (in the valve closing direction). As a result, the opening degree of the main valve becomes small and therefore the compressor operates in such a manner as to increase the discharging capacity. As a result, a change is made in a direction where the suction pressure Ps drops. Conversely, as the refrigeration load becomes small and the suction pressure Ps becomes lower than the set pressure Pset, the bellows 45 expands. As a result, the power element 6 biases the main valve element 30 in a valve opening direction so as to increase the opening degree of the main valve and therefore the compressor operates in such a manner as to reduce the discharge capacity. This maintains the suction pressure Ps at the set pressure Pset. As the suction pressure Ps becomes much larger than the set pressure Pset, it may be anticipated that the main valve is closed and the sub-valve is opened depending on a high-level suction pressure Ps. However, the presence of "deadband" (described later) until the opening of the sub-valve after the closing of the main valve prevents a situation, where the main valve and the sub-valve open and/or close unstably, from being happening.

If the engine load gets larger during such a steady control operation and therefore a reduction in the load to the air conditioner is desired, the conduction state (on/off) of the solenoid 3 is switched from on to off. This means that no suction power is in effect between the core 46 and the plunger 50. Thus the main valve element 30 gets separated away from the main valve seat 22 by the biasing force of the spring 44 and then the main valve is fully opened. At this time, the sub-valve element 36 is seated on the sub-valve seat 34 and therefore the sub-valve is closed. Thereby, the refrigerant, at the discharge pressure Pd, which has been introduced into the port 16 from the discharge chamber of the compressor passes through the fully opened main valve and flows into the crankcase from the port 14. Hence, the crank pressure Pc rises and then the compressor performs a minimum capacity operation.

A detailed description is now given of valve opening characteristics.

Figure 5:
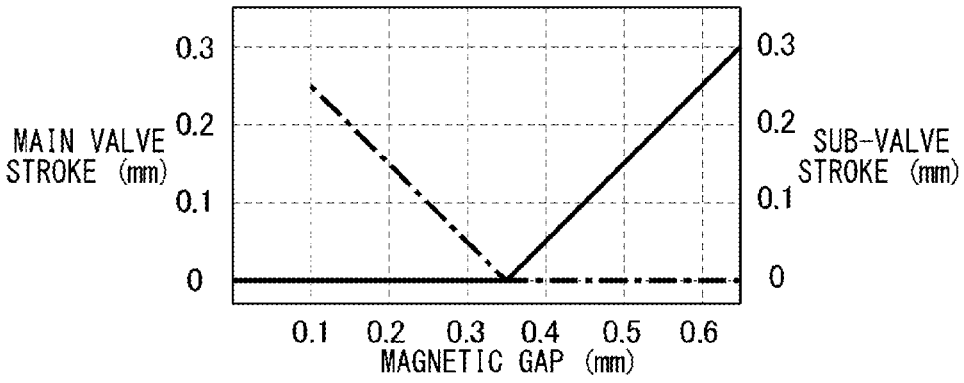
FIG. 5 is a graph showing valve opening characteristics of a control valve.

FIG. 5 and FIGS. 6A to 6C are each a graph showing the valve opening characteristics of a control valve. FIG. 5 shows open/close states of the main valve and the sub-valve in response to a displacement of the actuating rod. The horizontal axis of FIG. 5 represents magnetic gaps of the main valve element 30, and the vertical axis thereof represents the valve strokes of the main valve and the sub-valve. Here, the magnetic gap of the main valve element 30 is a distance between the core 46 and the plunger 50, and the valve stroke is an uplift amount of an applicable valve element from its applicable valve seat. The solid line in FIG. 5 indicates the main valve, and the dashed-dotted line (chain line) therein indicates the sub-valve.

As shown in FIG. 2A, the stroke of the main valve is the maximum when the solenoid 3 is turned off and the actuating rod 38 is at the bottom dead point. As shown in FIG. 3, the stroke of the sub-valve is the maximum when the solenoid 3 is switched from off to on and the actuating rod 38 is at a top dead point. As shown in FIG. 5, the sub-valve is fully opened when the magnetic gap is the minimum; the main valve is fully opened when the magnetic gap is the maximum. At an intermediate point of magnetic gaps (an intermediate point of displacement of the actuating rod 38), there is a fully-closed point where both the uplift amount of the main valve element 30 and the uplift amount of the sub-valve element 36 are zero, that is, as shown in FIG. 2B, both the main valve and the sub-valve are simultaneously closed. As the actuating rod 38 is displaced downward relative to the fully-closed point, the opening degree of the main valve becomes larger gradually while the sub-valve is being closed. Conversely, as the actuating rod 38 is displaced upward relative to the fully-closed point, the opening degree of the sub-valve becomes larger gradually while the main valve is being closed.

In the present embodiment, the seal section diameter of the sub-valve element 36 in the sub-valve is set almost equal to the seal section diameter of the main valve element 30 in the main valve. Thus, the main valve and the sub-valve have an almost equal inclination (slope) of the valve opening characteristics indicating the relation between the uplift amount and the valve opening degree (area of opening). In a modification, the seal section diameter of the sub-valve element 36 in the sub-valve may be set larger than that of the main valve element 30 in the main valve. According to this modification, the area of opening of the sub-valve can be varied more greatly as compared to the uplift amount of the sub-valve element 36 and therefore a large flow rate of refrigerant can be obtained at the time the sub-valve is open. Or alternatively, the seal section diameter of the sub-valve element 36 in the sub-valve may be set smaller than that of the main valve element 30 in the main valve.

Figure 6A:
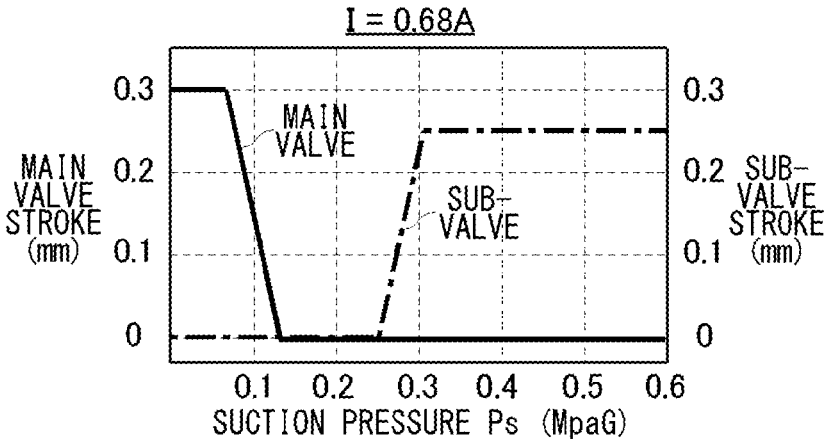
FIGS. 6A to 6C are each a graph showing valve opening characteristics of a control valve.
Figure 6B:
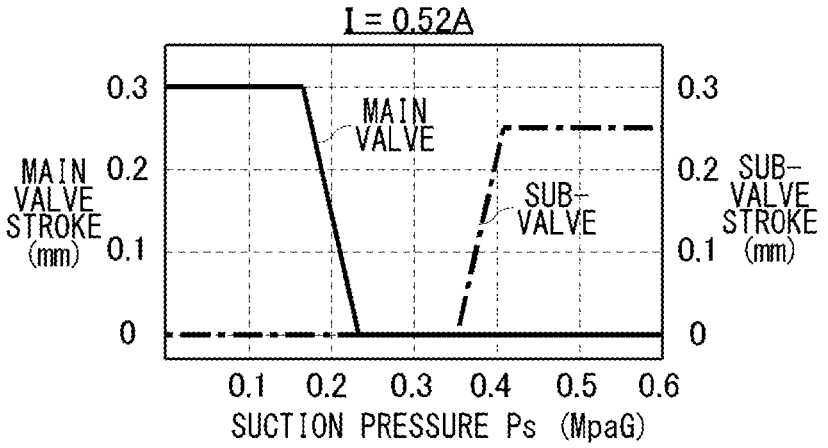
Figure 6C:
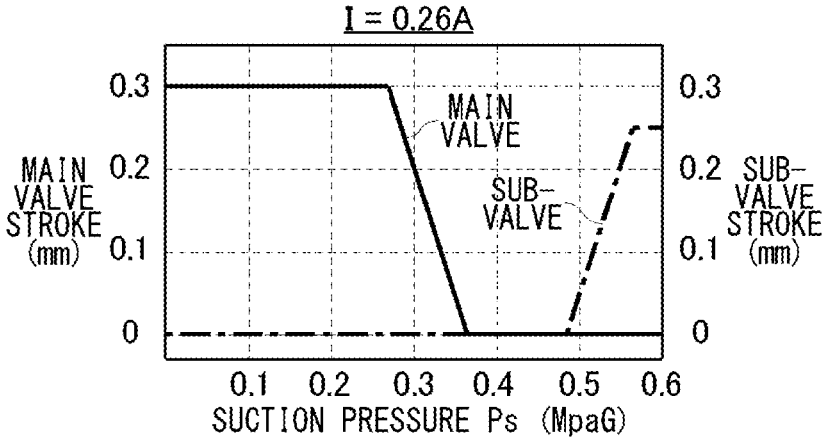

FIGS. 6A to 6C are graphs showing the valve opening characteristics in response to the suction pressure Ps corresponding to values of current supplied to the solenoid 3. In FIG. 6A, the supply current value is set to 0.68 (A). In FIG. 6B, the supply current value is set to 0.52 (A). In FIG. 6C, the supply current value is set to 0.26 (A). The vertical axis in each of FIGS. 6A to 6C represents the suction pressure Ps, and the horizontal axis therein represents the valve strokes. The solid line in each of FIGS. 6A to 6C indicates the main valve, and the dashed-dotted line therein indicates the sub-valve.

As is evident from FIGS. 6A to 6C, when the supply current value is constant, the valve closing point of the main valve and the valve opening point of the sub-valve are determined for the suction pressure Ps, and a range of pressures within which both the main valve and the sub-valve are closed is determined. Here, this range of pressures will be hereinafter referred to as "deadband". In other words, the valve closing point of the main valve is determined by four loads. Here, the four loads are the load of the solenoid 3 in response to the supply current value in a valve closing direction, the load of the spring 42 in a valve closing direction, the load of the spring 44 in a valve opening direction, and the load of the power element 6 in a valve opening direction. Also, the valve opening point of the sub-valve is determined, by the load of the spring 42 in a valve opening direction, based on the valve closing point of the main valve. In other words, the sub-valve starts to open at a point where the load of the power element 6 in a valve closing direction becomes smaller by an amount of load of the spring 42 acting on the sub-valve at the valve closing point of the main valve, namely at a point where the suction pressure Ps becomes higher by the reduced amount of load of the power element 6. Thus, the valve closing point of the main valve and the valve opening point of the sub-valve can be set by adjusting the load of the spring 42. Adjusting the value of current supplied to the solenoid 3 allows pressure values assumed during the course from the valve closing point of the main valve to the valve opening point of the sub-valve, namely the pressure values of the suction pressure Ps for which a deadband takes place, to be shifted in a high-pressure direction or a low-pressure direction.

More specifically, as shown in FIG. 6A, the pressure values, at which the suction pressure Ps takes the values of 0.13 to 0.25 (MPaG), obtained by setting the supply current value to 0.68 (A) are set as a deadband. And the sub-valve starts to open when the suction pressure Ps is 0.25 (MPaG) or above. As shown in FIG. 6B, the pressure values, at which the suction pressure Ps takes the values of 0.23 to 0.35 (MPaG), obtained by setting the supply current value to 0.52 (A) are set as a deadband. And the sub-valve starts to open when the suction pressure Ps is 0.35 (MPaG) or above. As shown in FIG. 6C, the pressure values, at which the suction pressure Ps takes the values of 0.36 to 0.48 (MPaG), obtained by setting the supply current value to 0.26 (A) are set as a deadband. And the sub-valve starts to open when the suction pressure Ps is 0.48 (MPaG) or above. According to the present embodiment, even though the suction pressure Ps is low, the sub-valve is able to be opened by causing the supply current value to rise.

Also, as shown in FIG. 6A to FIG. 6C, in the present embodiment, each deadband is set such that the deadband is given a width of 0.12 (MPa). For the purpose of preventing such an unstable state as the situation where the main valve and the sub-valve are alternately opened and closed, the width of each deadband is preferably so set as to be 0.05 (MPa) or more. In other words, if the width of the deadband is too small, the main valve and the sub-valve may be alternately opened and closed when the suction pressure Ps varies near the fully-closed point. In such a case, the rasping hitting sound may possibly be produced in the valve section and therefore the main valve and the sub-valve are more likely to be unstable. Such the unstable state is prevented by setting the width of the deadband to 0.05 (MPa) or above or more preferably 0.1 (MPa) or above.

Figure 7A:
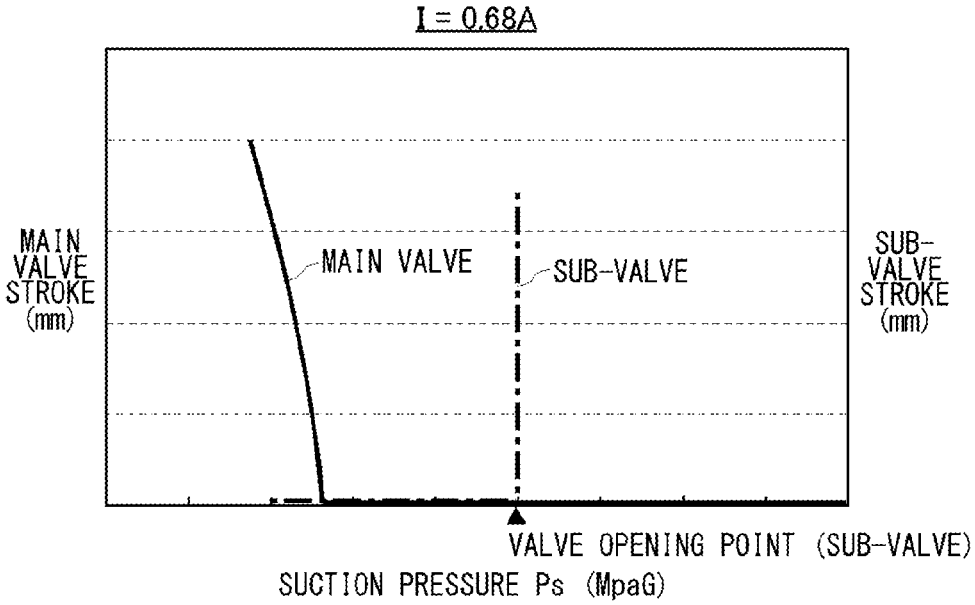
FIG. 7A and FIG. 7B are each a graph showing, in more detail, valve opening characteristics in response to a suction pressure Ps.
Figure 7B:
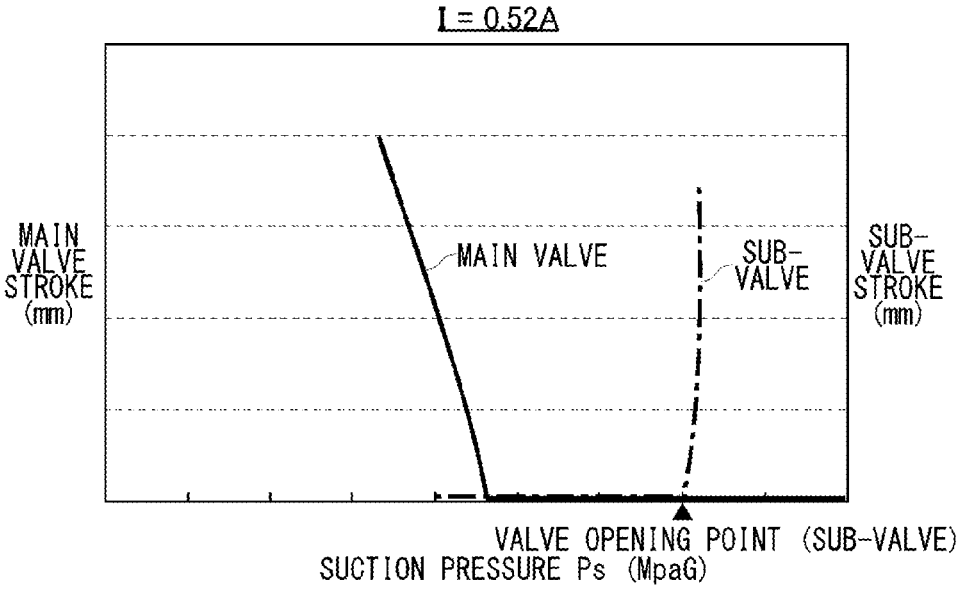
Figure 8:
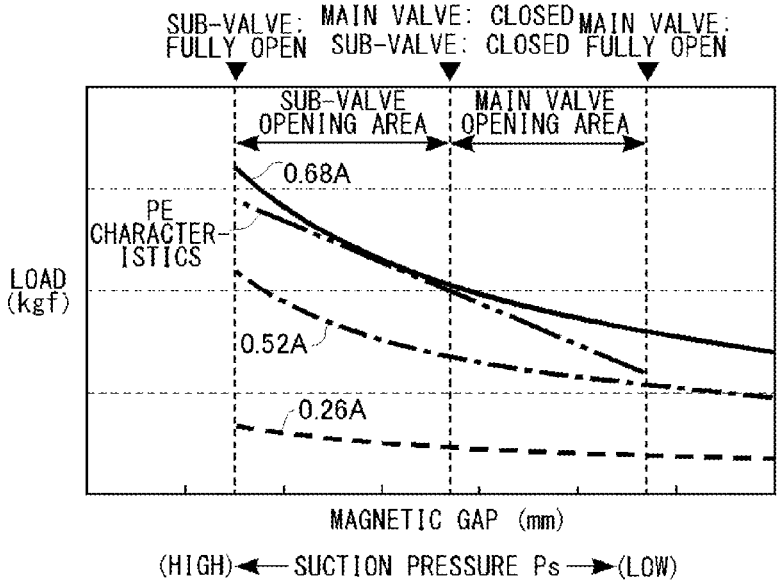
FIG. 8 is a graph showing a method for achieving the valve opening characteristics in FIG. 7A and FIG. 7B.

FIG. 7A and FIG. 7B are each a graph showing, in more detail, the valve opening characteristics in response to the suction pressure Ps. Similar to FIG. 6A, FIG. 7A shows a case where the supply current value is 0.68 (A). Similar to FIG. 6B, FIG. 7B shows a case where the supply current value is 0.52 (A). FIG. 8 is a graph showing a method for achieving the valve opening characteristics in FIG. 7A and FIG. 7B. The horizontal axis of FIG. 8 represents the magnetic gaps, and the vertical axis thereof represents suction force characteristics of the solenoid 3 or drive force characteristics of the power element 6. Where the supply current value is considered constant, the lower the suction pressure Ps is, the larger the magnetic gap will be; the higher the suction pressure Ps is, the smaller the magnetic gap will be.

As is evident from FIG. 7A and FIG. 7B, in the case where each supply current value is set, the sub-valve starts to open when the suction pressure Ps exceeds a certain value (valve opening point). The control valve has a valve opening property (valve opening characteristics) that the opening degree of the sub-valve increases as the suction pressure Ps become larger and that the opening degree thereof sharply changes to a fully-opened state after a predetermined fully-opened pressure. Note here that the value of the predetermined fully-opened pressure servers as a boundary value. In other words, as soon as the suction pressure Ps passes or reaches the predetermined fully-opened pressure value, the opening degree of the sub-valve sharply changes to the fully-opened state. As shown in FIG. 7A, in the case where the supply current value is 0.68 (A), the sub-valve is fully opened almost simultaneously with the opening of the sub-valve. As in FIG. 7B, on the other hand, in the case where the supply current value is 0.52 (A), the sub-valve is fully opened all at once after the suction pressure Ps becomes slightly higher than the valve opening point. Thus, the responsiveness of the sub-valve at the time the sub-valve is opened can be improved by setting the supply current value to 0.68 (A) rather than 0.52 (A).

Such a valve opening property (valve opening characteristics) is determined by a relationship between the suction force characteristics of the solenoid 3 and the drive force characteristics of the power element 6 as shown in FIG. 8. The drive force characteristics of the power element 6 is hereinafter referred to as "loading characteristics", "loading characteristic" or "loading property" and is denoted by "PE characteristics (power element characteristics)" in FIG. 8. In other words, the inclination (slope) of suction force characteristics of the solenoid 3 is set larger than that of drive force characteristics of the power element 6 after the predetermined fully-opened pressure, with respect to a change in the magnetic gap of the solenoid 3 that varies according to the suction pressure Ps. This achieves the valve opening characteristics. For example, where the supply current value is 0.68 (A), the inclination of suction force characteristics (solid line) of the solenoid 3 is larger than that of drive force characteristics of the power element 6 (two-dot chain line), in almost entirely of the valve opening area of the sub-valve. As a result, as shown in FIG. 7A, at almost the same time as the suction pressure Ps gets higher than the valve opening point, the sub-valve sharply changes to the fully-opened state. For example, on the other hand, where the supply current value is 0.52 (A), the inclination of suction force characteristics (chain line) of the solenoid 3 is larger than that of drive force characteristics of the power element 6 (two-dot chain line), near a median value of a sub-valve opening area. As a result, as shown in FIG. 7B, when the suction pressure Ps gets slightly higher than the valve opening point, the sub-valve sharply changes to the fully-opened state.

Figure 9:
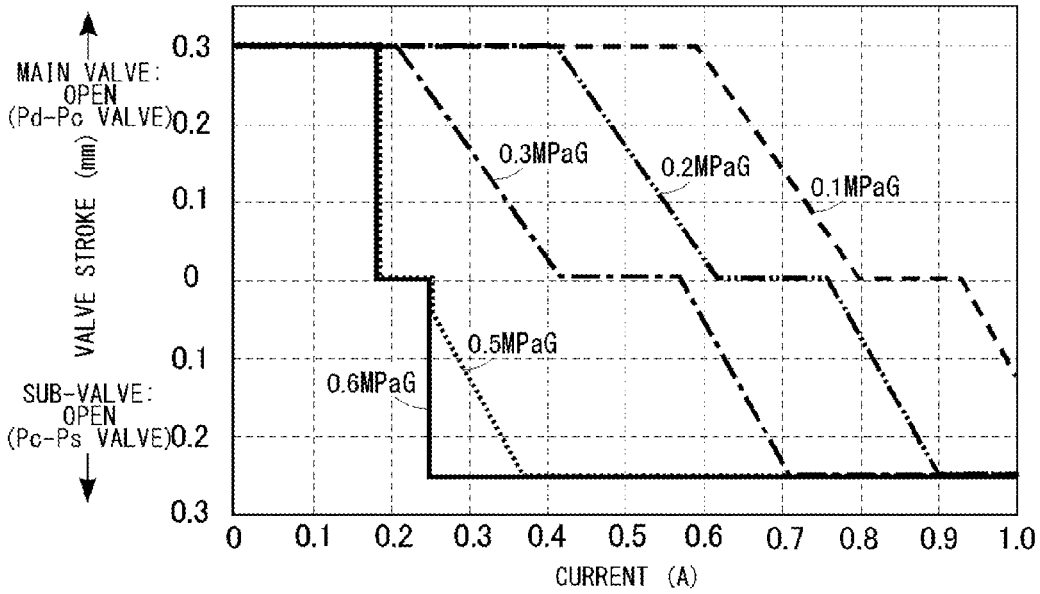
FIG. 9 is a graph showing a relationship between a supply current value to solenoid and valve opening characteristics in response to a suction pressure Ps.

FIG. 9 is a graph showing a relationship between the supply current value to the solenoid and the valve opening characteristics in response to the suction pressure Ps. The horizontal axis indicates the supply current values, and the vertical axis indicates the valve strokes (valve opening degrees). When the suction pressure Ps is 0.6 (MPaG), the valve opening characteristics are indicated by a solid line in FIG. 9. When the suction pressure Ps is 0.5 (MPaG), the valve opening characteristics are indicated by a dotted line in FIG. 9. When the suction pressure Ps is 0.3 (MPaG), the valve opening characteristics are indicated by a dashed-dotted line in FIG. 9. When the suction pressure Ps is 0.2 (MPaG), the valve opening characteristics are indicated by a two-dot chain line in FIG. 9. When the suction pressure Ps is 0.1 (MPaG), the valve opening characteristics are indicated by a broken line in FIG. 9.

It is evident from FIG. 9 that when, for example, the suction pressure Ps is 0.5 or 0.6 (MPaG), the valve opening point of the sub-valve is 0.25 (A). Here, the valve opening point of the sub-valve point represents a boundary point in a current value where the state of the sub-valve changes from a closed state to an open state. When the suction pressure Ps is 0.3 (MPaG), the valve opening point of the sub-valve is 0.57 (A). When the suction pressure Ps is 0.2 (MPaG), the valve opening point of the sub-valve is 0.76 (A). When the suction pressure Ps is 0.1 (MPaG), the valve opening point of the sub-valve is 0.93 (A). This means that when a current exceeding a valve opening point according to a given suction pressure Ps is supplied, the sub-valve is opened. Here, the "current exceeding a valve opening point according to a given suction pressure Ps" is hereinafter referred to as "valve opening current" also. In other words, when, in a state where a supply current value with which to set the suction pressure Ps at the set pressure Pset has been set, the supply current value is a valve opening current corresponding to the present suction pressure Ps, the sub-valve is opened; otherwise, the sub-valve maintains the closed state.

Suppose, in the present embodiment, that the supply current value is set to 0.68 (A) in order to set the set pressure Pset at 0.1 (MPaG), for instance. In this case, if the suction pressure Ps at a startup of the compressor is in a high-load state of 0.5 or 0.6 (MPaG), the sub-valve will be immediately fully-opened and the compressor will promptly shift its operation mode to a maximum-capacity operation. As a result, the suction pressure Ps drops and is brought close to 0.1 (MPaG). If the suction pressure Ps is about 0.3 (MPaG), the sub-valve will be opened to a predetermined opening degree to which the sub-valve is not fully opened, and shifting the operational mode of the compressor to the maximum-capacity operation is accelerated. As a result, the suction pressure Ps relatively quickly drops and is brought close to 0.1 (MPaG). If the suction pressure Ps is about 0.2 (MPaG), the compressor will be started without the trouble of opening the sub-valve. However, the compressor has been started with the main valve being closed and therefore the suction pressure Ps drops and is brought close to 0.1 (MPaG). If the suction pressure Ps is about 0.1 (MPaG), the opening degree of the main valve will be controlled with the sub-valve remained closed in such a manner as to keep this state.

Suppose, in the present embodiment, that the supply current value is set to 0.52 (A) in order to set the set pressure Pset at 0.2 (MPaG), for instance. In this case, if the suction pressure Ps at a startup of the compressor is in a high-load state of 0.5 or 0.6 (MPaG), the sub-valve will be immediately fully-opened and the compressor will promptly shift its operation mode to a maximum-capacity operation. As a result, the suction pressure Ps drops and is brought close to 0.2 (MPaG). If the suction pressure Ps is about 0.3 (MPaG), the compressor will be started without the trouble of opening the sub-valve. However, the compressor has been started with the main valve being closed and therefore the suction pressure Ps drops and is brought close to 0.2 (MPaG). If the suction pressure Ps is about 0.2 (MPaG), the opening degree of the main valve will be controlled with the sub-valve remained closed in such a manner as to keep this state. If the suction pressure Ps is in a low-load state of about 0.1 (MPaG), the main valve will be immediately fully-opened while the sub-valve remains closed, and the compressor will promptly shift its operation mode to a minimum-capacity operation. As a result, the suction pressure Ps quickly rises and is brought close to 0.2 (MPaG).

As described above, in the present embodiment, the valve opening characteristics of the sub-valve are regulated, as appropriate, so that the suction pressure Ps can be quickly brought close to a set pressure Pset in response to a supply current value corresponding to the set pressure Pset. When observed for each suction pressure Ps, the range of the supply current values, where the main valve and the sub-valve are simultaneously closed, exists as a deadband. In FIG. 9, when the suction pressure Ps is 0.5 or 0.6 (MPaG), the range of 0.18 to 0.25 (A) is the deadband. Similarly, when the suction pressure Ps is 0.3 (MPaG), the range of 0.42 to 0.57 (A) is the deadband. When the suction pressure Ps is 0.2 (MPaG), the range of 0.62 to 0.76 (A) is the deadband. When the suction pressure Ps is 0.1 (MPaG), the range of 0.80 to 0.93 (A) is the deadband. In the present embodiment, when controlling the on/off of the solenoid is performed by a duty control using a pulse width modulation (PWM) of about 400 Hz, the supply current value with which to set the set pressure Pset is set to an intermediate value (near a median value) of the deadband. This enables the simultaneous closed states (the fully-closed point) of the main valve and the sub-valve to be maintained in a stabilized manner. This also prevents a situation where the main valve and the sub-valve are alternately opened and closed and thereby a rasping collision noise occurs.

An additional description is now given of a case where the state of FIG. 2A changes to the state of FIG. 3, based on FIG. 9. If, for example, the suction pressure Ps is as relatively high as about 0.6 (MPaG), the state of FIG. 2A changes to the state of FIG. 3. In other words, as the suction pressure Ps becomes about 0.6 (MPaG), the bellows 45 is the minimum and consequently does not function. As a result, the sub-valve element 36 operates depending on only the solenoidal force opposing the biasing force of the spring. That is, the movement of the sub-valve element 36 does not depend on the suction pressure Ps but depends on the supply current value. In such a case, as the supply current value is increased, the main valve is closed when the supply current value hits a current value (e.g., 0.18 (A)) overcoming a difference between the spring loads of the springs 42 and 44. Then the both the main valve and the sub-valve are closed. As, in this state, the supply current value is further increased, the sub-valve element 36 starts to lift from the sub-valve seat 34 when the spring load of the spring 42 acts entirely on the main valve seat 22 (e.g., 0.25 (A)). Although the deadband where the supply current value serves as a parameter is set in FIG. 9, it goes without saying that this is synonymous with the setting of the deadband where the suction pressure Ps servers as a parameter in FIGS. 6A to 6C. In other words, FIG. 9 is derived by replacing the pressure-based property as in FIG. 6 with the current-based values.

As shown in FIG. 9, in the case where the suction pressure is 0.6 (MPaG), the inclination of the valve stroke relative to the supply current value is vertical at the time of opening/closing of each of the main valve and the sub-valve. In other words, as the supply current value is increased from "0", a change is made all at once from the fully-opened state of the main valve (the valve stroke: 0.3 mm) to the closed states (fully-closed states) of the main valve and the sub-valve when the supply current value hits 0.18 (A). Similarly, a change is made all at once from the closed state of the sub-valve to the fully-opened state thereof (the valve stroke: 0.25 mm) when the supply current value hits 0.25 (A). Also, the width of the deadband at 0.6 (MPaG) is smaller than that at 0.3 (MPaG). Regarding this point, a description is given as follows.

Figure 10:
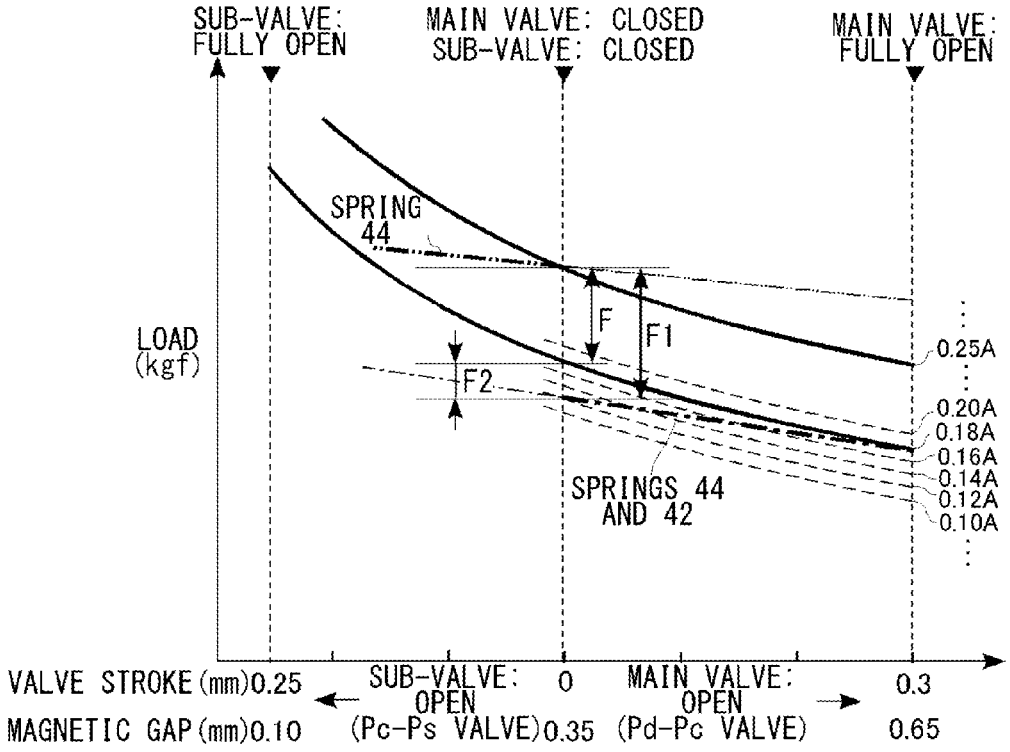
FIG. 10 is a graph for explaining why the valve opening characteristics are provided in the case of 0.6 (MPaG) shown in FIG. 9.

FIG. 10 is a graph for explaining why the valve opening characteristics are provided in the case of 0.6 (MPaG) shown in FIG. 9. The horizontal axis represents the valve strokes (valve opening degrees) of the main valve and the sub-valve and the magnetic gas, and the vertical axis represents the suction force characteristics of the solenoid 3 in response to the supply current value and the loading characteristics of the spring. In FIG. 10, the solid line and the broken line indicate the suction force characteristics of the solenoid 3, and the dashed-dotted line and the two-dot chain line indicate the loading characteristics of the spring.

As is evident from FIG. 10, as the supply current value is increased from a point where the main valve is fully opened (the main valve stroke 0.3 mm), the suction force of the solenoid 3 exceeds the loads (the resultant force) of the springs 42 and 44 when the supply current value reaches 0.18 (A). As a result, the main valve element 30 starts to be displaced in a valve closing direction. At this time, the inclination of suction force characteristics of the solenoid 3 is larger than that of drive force characteristics of the springs 42 and 44. Hence, as the opening degree of the main valve becomes smaller, the difference between the solenoidal force and the spring load becomes larger without further increasing the current value. This causes the main valve element 30 to be displaced all at once toward the fully-closed point while the current value is kept at 0.18 (A). As a result, the inclination of change in the stroke of the main valve becomes almost vertical as shown in FIG. 9.

Immediately after the main valve element 30 is seated on the main valve seat 22, the load of the spring 42 acts on both the main valve element 30 and the sub-valve element 36. In this state, a load F of the spring 42 assigned to the sub-valve element 36 is gradually shifted to the main valve seat 22 as the solenoidal force becomes larger as a result of an increase in the supply current value. The sub-valve starts to open when all of the load of the spring 42 has been shifted to the main valve seat 22. This load F produces the deadband.

As the supply current value reaches 0.25 (A), all of the load of the spring 42 is shifted to the main valve seat 22. Since at this time the suction force of the solenoid 3 exceeds the load of the spring 44, the sub-valve element 36 starts to be displaced toward an opening direction of the sub-valve. At this time, the inclination of suction force characteristics of the solenoid 3 is larger than that of drive force characteristics of the spring 44. Hence, as the opening degree of the sub-valve becomes larger, the difference between the solenoidal force and the spring load becomes larger without changing the current value. This causes the sub-valve element 36 to be displaced all at once toward the valve opening point while the current value is kept at 0.25 (A). As a result, the inclination of change in the stroke of the sub-valve becomes almost vertical as shown in FIG. 9.

Also, where the suction pressure Ps in FIG. 10 is 0.6 (MPaG), the inclination of suction force characteristics of the solenoid 3 is larger than that of the loads of drive force characteristics of the springs 42 and 44, over an entire stroke area of the main valve. Hence, as the main valve starts to be closed at 0.18 (A), the suction force of the solenoid 3 increases by reducing the opening degree of the main valve. In other words, the solenoidal force increases without having the supply current value increased, and the thus increased solenoidal force works in such a direction as to cancel out a load F2, which is part of the loads (the resultant force) of the springs 42 and 44. Since the load F2 eventually cancels out part of the deadband, the width of the deadband is small. That is, if the inclination of the loads of drive force characteristics of the springs at the time the supply current value is 0.18 (A) is larger than that of suction force characteristics, a load F1 in FIG. 10 would generate a deadband. However, since the inclination of suction force characteristics is larger than that of the loads of drive force characteristics of the springs, the deadband is smaller by the amount of the load F2. In the case like this when the suction pressure Ps is 0.6 (MPaG), the supply current value is set to an intermediate value (near a median value) of such the deadband even though the width of the deadband is small. This enables the simultaneous closed states (the fully-closed point) of the main valve and the sub-valve to be maintained in a stabilized manner. This also prevents a situation where the main valve and the sub-valve are alternately opened and closed and thereby a rasping collision noise occurs. In other words, it is safely said that a sufficient width of deadband is ensured for the deadband to have such a function effect. The similar advantageous effects are also achieved in the case when the suction pressure Ps is 0.5 (MPaG).

As described above, in the present embodiments, the valve opening point of the main valve is set by regulating the loads of the springs 42 and 44 and the power element 6; the valve opening point of the sub-valve is set by regulating the loads of the spring 44 and the power element 6. Also, the value of the suction pressure Ps with which to close the main valve, the value of the suction pressure Ps with which to open the sub-valve after the main valve has been closed, and the pressure values of the suction pressure Ps at which the deadband takes place are set by setting the value of current supplied to the solenoid 3. Also, the value of the suction pressure Ps with which to open the sub-valve after the main valve has been closed is given an appropriate range of values. This can prevent a situation like one where the main valve and the sub-valve are alternately opened and closed, so that the bleed function can be achieved in a more stabilized manner. Also, the value of the suction pressure Ps at which the sub-valve moves to open is appropriately varied by varying the value of current supplied to the solenoid 3. Accordingly, the sub-valve opening pressure is also varied by varying the supply current value and thereby varying the set pressure Pset according as, for example, the vehicle is exposed to a high-temperature environment or a low-temperature environment. As a result, the bleed function can be promptly achieved in any one of such the environments. In other words, the condition under which the sub-valve can be opened is not limited to the cases where the pressure sensed by the power element 6 exceeds a specific pressure value (fixed value). Hence, the bleed function can be appropriately achieved depending on an air-conditioning state or environment. Furthermore, the sub-valve chamber 26 where the sub-valve is placed is configured such that the diameter of the sub-valve chamber 26 is larger than that of the main valve hole 20. Thus, a sufficient flow rate of refrigerant flowing through the sub-passage can be ensured when the sub-valve is opened, so that the bleed function can be achieved more effectively.

The description of the present invention given above is based upon illustrative embodiments. These embodiments are intended to be illustrative only and it will be obvious to those skilled in the art that various modifications could be developed within the technical idea underlying the present invention.

In the above-described embodiments, the description has been given of a so-called Ps sensing valve, as an example of the control valve, which is enabled upon directly sensing the suction pressure Ps and where the power element 6 is placed in the working chamber 23 filled with the refrigerant at the suction pressure Ps. In a modification, the control valve may be constituted as a Ps sensing valve, which is enabled upon practically sensing the suction pressure Ps. Specifically, the control valve according to this modification may be configured such that the power element is placed in a pressure chamber filled with the refrigerant at the crank pressure Pc and such that the crank pressure Pc is canceled.

In the above-described embodiments, the description has been given of an example where the bellows 45 is used for a pressure-sensing member that constitutes the power element 6. A diaphragm may be used, instead. In such a case, the structure may be such that a plurality of diaphragms are coupled in the direction of axis line in order to ensure a necessary running stroke required for the pressure-sensing member.

In the above-described embodiments, the description has been given of an example where a spring (coil spring) is used as the biasing member regarding the springs 42, 44, 88 and the like. It goes without saying that an elastic material, such as rubber or resin, or an elastic mechanism, such as a plate spring, may be used instead.

In the above-described embodiments, the description has been given of the case where the reference pressure chamber S inside the bellows 45 is in a vacuum state. Instead, the reference pressure chamber S may be filled with air or filled with a predetermined gas serving as a reference. Or alternatively, it may be so filled as to have any one of the discharge pressure Pd, the crank pressure PC, and the suction pressure Ps. In such a case, the power element may be configured such that the power element is activated by sensing, as appropriate, the pressure difference between the interior and the exterior of the bellows. Also, in the above-described embodiments, the description has been given of the structure where the pressures Pd, Pc and Ps directly received by the main valve element are canceled. Instead, the structure may be such that at least any one of the pressures Pd, Pc and Ps is not canceled.

The present invention is not limited to the above-described embodiments and the modifications only, and those components may be further modified to arrive at various other embodiments without departing from the scope of the invention. Also, various other embodiments may be further formed by combining, as appropriate, a plurality of structural components disclosed in the above-described embodiments and the modifications. Also, one or some of all of the components exemplified in the above-described embodiments and the modifications may be left unused or removed.

What is claimed is:

1. A control valve for a variable displacement compressor for varying a discharging capacity of the compressor for compressing refrigerant led into a suction chamber and discharging the compressed refrigerant from a discharge chamber, by regulating a flow rate of the refrigerant led into a crankcase from the discharge chamber, the control valve comprising:

a body having:

a discharge chamber communication port that communicates with the discharge chamber;

a crankcase communication port that communicates with the crankcase;

a suction chamber communication port that communicates with the suction chamber;

a main passage that communicates between the discharge chamber communication port and the crankcase communication port; and a sub-passage that communicates between the crankcase communication port and the suction chamber communication port;

a main valve provided in the main passage, the main valve comprising a main valve element and a main valve seat, the main valve element being configured to open and close the main valve by leaving and touching the main valve seat so as to open and block the main passage;

a sub-valve provided in the sub-passage, the sub-valve comprising a sub-valve element and a sub-valve seat, the sub-valve element being configured to open and close the sub-valve by leaving and touching the sub-valve seat so as to open and block the sub-passage;

a power element that supplies a drive force in a valve opening direction to the main valve element according to a displacement amount of a pressure-sensing member, the power element including the pressure-sensing member for sensing a predetermined pressure-to-be-sensed and developing a displacement in an opening or closing direction of the main valve;

a solenoid configured to generate a force opposing the drive force of the power element when the solenoid electrically conducts;

an actuating rod configured to transmit the force generated by the solenoid to the power element, the actuating rod being coupled with the solenoid; and a biasing member located in the body to bias the main valve element in a closing direction of the main valve, wherein a portion of the body is formed to serve as the main valve seat, wherein a surface of the main valve element facing the sub-valve element serves as the sub-valve seat, wherein, during steady control where an opening degree of the main valve is regulated, a biasing force of the biasing member presses the main valve element against the sub-valve element to keep the sub-valve in a closed state, wherein the main valve element, the sub-valve element, and the actuating rod are arranged so that a state in which both of the main valve and the sub-valve are closed exists during a process of the main valve and the sub-valve being switched between open and closed states;

wherein a load of the biasing member is set so that the pressure-to-be-sensed has a range in value within which both of the main valve and the sub-valve are closed with respect to an amount of current supplied to the solenoid;

wherein the range of the pressures-to-be-sensed, where both of the main valve and the sub-valve are closed until the sub-valve element is lifted from the sub-valve seat after the main valve element has been seated on the main valve seat, is set as a deadband, and wherein a lowest value and a highest value of the pressure-to-be-sensed defining the deadband are variable according to the amount of current supplied to the solenoid, the lowest value being a value at which the main valve is closed, the highest value being, a value at which the sub-valve is opened after the main valve has been closed.

2. The control valve, for a variable displacement compressor, according to claim 1, wherein the actuating rod and the main valve element are each configured by separated elements, wherein the biasing member biases the main valve element such that when the main valve is open, the main valve element follows movements of the actuating rod and the pressure-sensing member, and wherein, when the main valve is closed, the sub-valve is able to be opened by displacing the main valve element and the actuating rod relative to each other.

* * * * *